US006869317B2

(12) United States Patent
Weatherley

(10) Patent No.: US 6,869,317 B2
(45) Date of Patent: Mar. 22, 2005

(54) JACK FOR DATA TRANSMISSION

(75) Inventor: Richard Weatherley, Brackmills (GB)

(73) Assignee: Hellermanntyton Data Limited, Crawley (GB)

( * ) Notice: Subject to any disclaimer, the term of this patent is extended or adjusted under 35 U.S.C. 154(b) by 61 days.

(21) Appl. No.: 10/380,072

(22) PCT Filed: Jul. 5, 2001

(86) PCT No.: PCT/GB01/03018

§ 371 (c)(1),
(2), (4) Date: Jun. 2, 2003

(87) PCT Pub. No.: WO02/23681

PCT Pub. Date: Mar. 21, 2002

(65) Prior Publication Data

US 2004/0033728 A1 Feb. 19, 2004

(30) Foreign Application Priority Data

Sep. 15, 2000 (GB) ..... 0022727

(51) Int. Cl.[7] ..... H01R 24/00
(52) U.S. Cl. ..... 439/676; 439/941
(58) Field of Search ..... 439/676, 941, 439/620, 344, 630

(56) References Cited

U.S. PATENT DOCUMENTS 5,362,257 A 11/1994 Neal et al.
5,547,405 A 8/1996 Pinney et al.
5,599,209 A * 2/1997 Belopolsky ..... 439/676
5,938,479 A 8/1999 Paulsen et al.
6,007,368 A 12/1999 Lorenz et al.
6,179,668 B1 * 1/2001 Kan ..... 439/676
6,283,795 B1 * 9/2001 Chen ..... 439/676

FOREIGN PATENT DOCUMENTS

EP 0692884 1/1996
WO 9963630 12/1999

* cited by examiner

*Primary Examiner*—Tho D. Ta
*Assistant Examiner*—Felix O. Figueroa
(74) *Attorney, Agent, or Firm*—Dykema Gossett PLLC

(57) ABSTRACT

This invention relates to an improved jack for data transmission, and in particular provides the jack having improved cross-torque characteristics. A jack is provided comprising a body having m unted thereon a multiplicity of metal strips. The strips include a first group of metal strips each of which includes a contact portion (7) for contacting a conductor of a mating plug and a connection portion for connection to a printed circuit board on which the jack, in use, is mounted. The strips also include a second group of metal strips each of which extends parallel to at least one metal strip of the first group over a part of the length of the metal strip of the first group and which is electrically connected to a different metal strip of the first group.

7 Claims, 6 Drawing Sheets

JACK FOR DATA TRANSMISSION

BACKGROUND OF THE INVENTION

1. Field of the Invention

This invention relates to an improved jack for data transmission, and in the preferred embodiment provides a jack having improved cross-talk characteristics.

2. The Prior Art

Jacks (and their associated plugs) are widely used in data transmission systems for providing a plug-in connection between components. For example, jacks are extensively used on patch panels and wall outlets of structured cabling systems and on electronic equipment to permit connection of equipment to structured cabling systems using patch leads. The so called RJ45 plug is extensively used within the cabling industry and the vast majority of jacks are devised to be compatible with RJ45 plugs.

There are various internationally agreed standards for the performance of structured cabling systems. The current mainstream standards are the so called "Category 5" (commonly referred to as Cat 5) and the somewhat improved "Category 5 enhanced" (generally referred to as Cat 5e). A higher standard (Category 6 or Cat 6) has recently been proposed. Cat 6 specifications require lower levels of near end cross-talk (NEXT) and far end cross-talk (FEXT) and improved return loss values than the earlier Cat 5 and Cat 5e standards. In order to meet Cat 6standards it has been necessary to re-design both plugs and jacks, whilst keeping within the physical parameters of the RJ45 plug specification.

By careful design of the plug and the circuit board to which the jack is secured it has been possible to design plug and jack combinations which meet Cat 6 standards without any fundamental alteration to the standard jack construction. However, it is now considered desirable that both the plug and jack of Cat 6 specification equipment must be capable of meeting Cat 5 specification when used with a mating Cat 5 component. In other words, it is now desirable that when a Cat 6 plug is inserted into a Cat 5 jack, or a Cat 5 plug is inserted in a Cat 6 jack, the overall combination should meet Cat 5 standards.

We have now devised an improved jack which assists in meeting the desideratum of rearward compatibility to Cat 5 standards.

SUMMARY OF THE INVENTION

According to one aspect of the present invention a jack comprises a body having mounted thereon a multiplicity of metal strips, the metal strips including: a first group of metal strips each of which includes a contact portion for contacting a conductor of a mating plug and a connection portion for connection to a printed circuit board on which the jack, in use, is mounted; and a second group of metal strips each of which extends parallel to at least one metal strip of the first group over a part of the length of the metal strip of the first group and which is electrically connected to a different metal strip of the first group.

In the preferred embodiment of the invention the strips of the second group are cropped so that they do not include any portion in the region of the contact portions of the first group of metal strips.

Preferably, the metal strips include a common region which is encapsulated in a suitable plastics material. The contact portions of the first group extend from one end of the encapsulated region and the connection portions of the first group of strips extend from the other end of the encapsulated region. Preferably, the strips of the second group do not extend beyond the encapsulated region in the direction of the contact portions.

In the particularly preferred embodiment of the invention the contact strips are formed by two superimposed layers of a pre-formed common blank, one of the layers of blank being inverted relative to the other layer.

In the particularly preferred embodiment of the invention at least some of the strips include pad portions which co-operate with the pad portions of others of the strips to enhance impedance matching characteristics of the jack.

The above and further features and advantages of the invention will become clear from the following description of a preferred embodiment thereof given by way of example only, reference being had to the accompanying drawings wherein:

DETAILED DESCRIPTION OF THE PREFERRED EMBODIMENT

Figure 1:
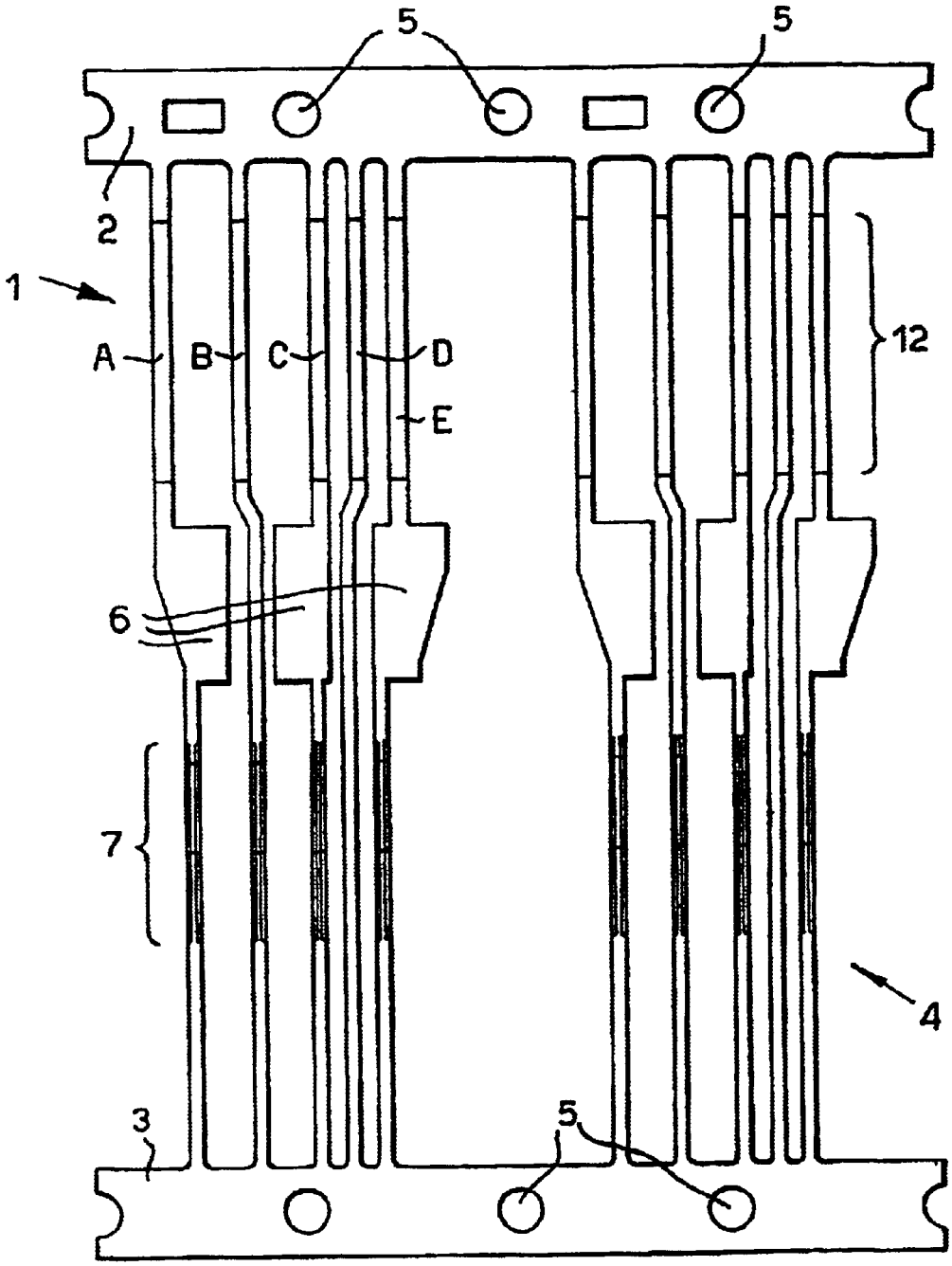
FIG. 1 is a plan view of a portion of blank material used in the manufacture of jacks in accordance with the preferred embodiment of the invention.
Figure 2:
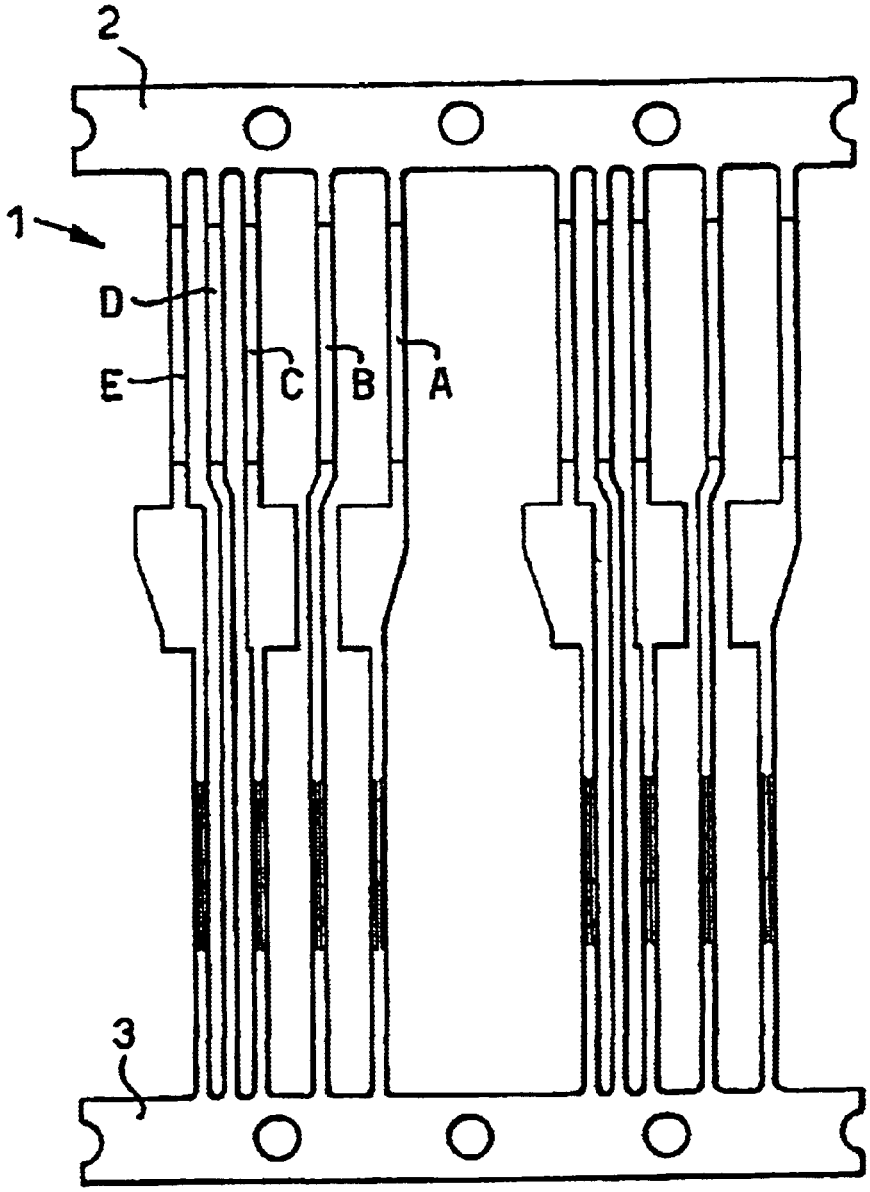
FIG. 2 is a view of the blank of FIG. 1 inverted relative to the position shown in FIG. 1.

Referring firstly to FIGS. 1 and 2, the blank material 1 used in the manufacture of jacks according to the present invention comprises side regions 2, 3 and strips 4 extending between the side regions. The blanks may be formed by any suitable means, from any suitable material. For example, they may be formed by stamping from phosphor-bronze. The side regions 2, 3 include holes 5. The holes 5 serve to receive drive pins in automated assembly equipment and ensure correct registration of the superimposed blanks, as described below.

Each groups of strips 4 comprises five strips A,B,C,D, and E. It will be noted that, as manufactured, each strip is continuous between and is initially integral with the side regions 2,3. The strips A,C and E include pads 6 for impedance matching purposes, as described in more detail below.

The strips A,B,C and E will, in the finished jack, provide contact portions for electrical connection to corresponding contacts of a plug. The region 7 of the strips which will provide the contact portions may be suitably treated after the blanks have been formed, for example by mechanical treatment and/or electro-plating.

It will be noted that the strip D will not provide a contact portion in the finished jack.

In order to form a jack, two layers of the blank material are required, the second layer being superimposed on the first layer but inverted relative to the first layer. The blank 1 shown in FIG. 2 has this inverted relationship relative to the blank of FIG. 1.

Figure 3:
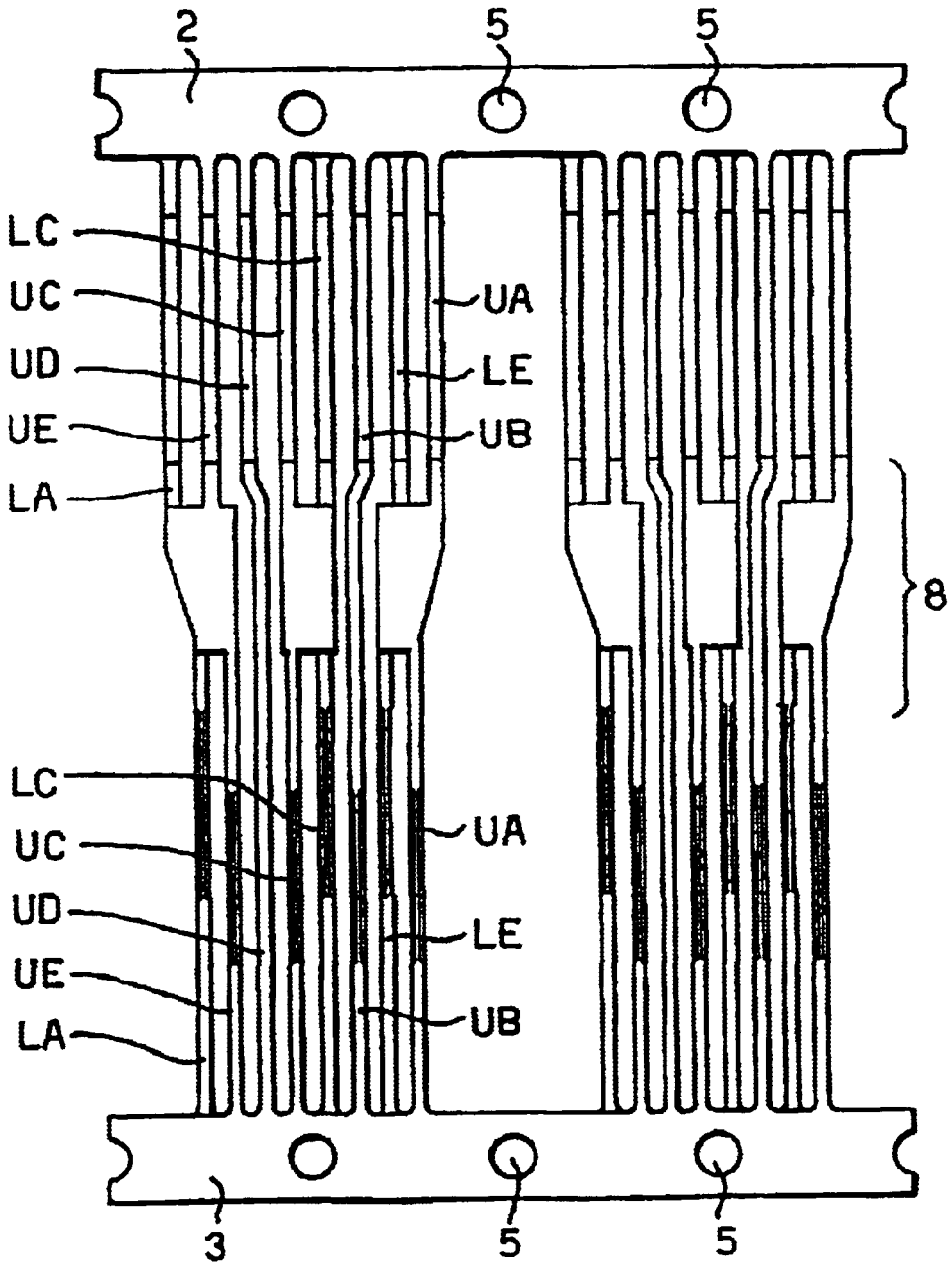
FIG. 3 is a plan view of the blank of FIG. 2 superimposed on and in register with the blank of FIG. 1.

To form the jack, the two layers of blank material are superimposed as shown in FIG. 3, the holes 5 being used to ensure correct registration of the two layers. In FIG. 3, the various strips of the upper layer are identified with the prefix "U" and the various strips of the lower layer are prefixed with the "L". It will be noted that in the superimposed configuration shown in FIG. 3 the lower B strip LB is not visible since it lies directly underneath and is covered by the upper D strip UD. Likewise, the lower D strip LD is not visible in FIG. 3 since it lies under and is covered by the upper B strip UB.

In order to form a contact sub-assembly for insertion into a jack body a common central region 8 of the strips 4 is encapsulated in a suitable plastics encapsulation 9. As a practical matter, the encapsulation can conveniently be done in two stages by forming an initial encapsulation 9A which encapsulates the common region 8 of the lower blank and forming a second encapsulation 9B which encapsulates the common region 8 of the upper blank. The encapsulations 9A and 9B may be formed separately and fixed together after moulding. Alternatively, encapsulation 9A may be formed, the upper blank may be superimposed on that encapsulation, and the encapsulation 9B may be formed in situ. The resultant arrangement is shown on the left hand portion of FIG. 4 and the arrangement of the strips prior to encapsulation is shown on the right hand portion of FIG. 4. It will be appreciated that, in practice, there will be a number of intermediate stages between the left and right hand portions of FIG. 4. The totally unencapsulated and totally encapsulated stages are shown in juxtaposition for convenience only.

Figure 4:
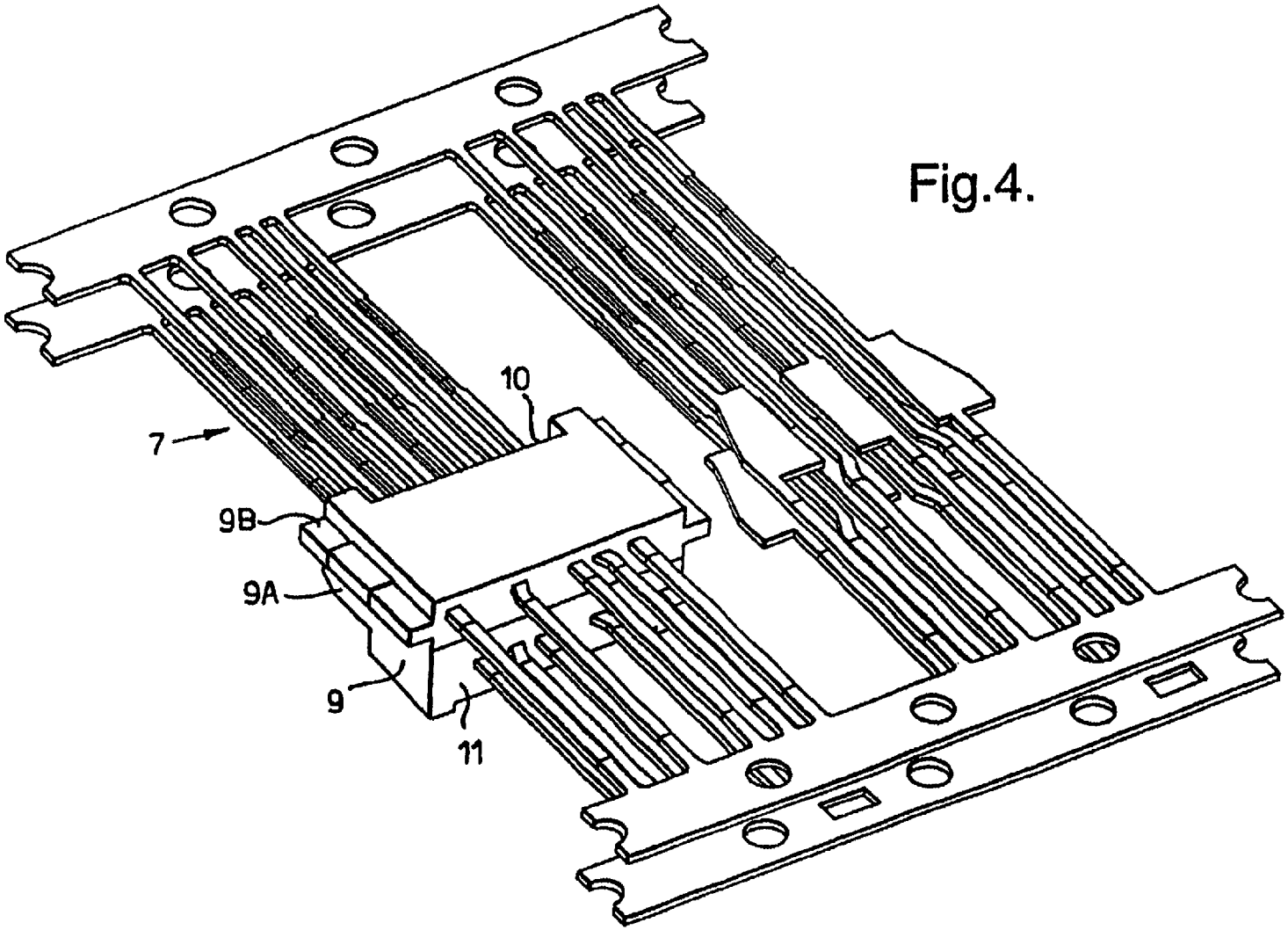
FIG. 4 is a perspective view of the superimposed strips of FIG. 3 showing the encapsulation of a common region of the strips.
Figure 5:
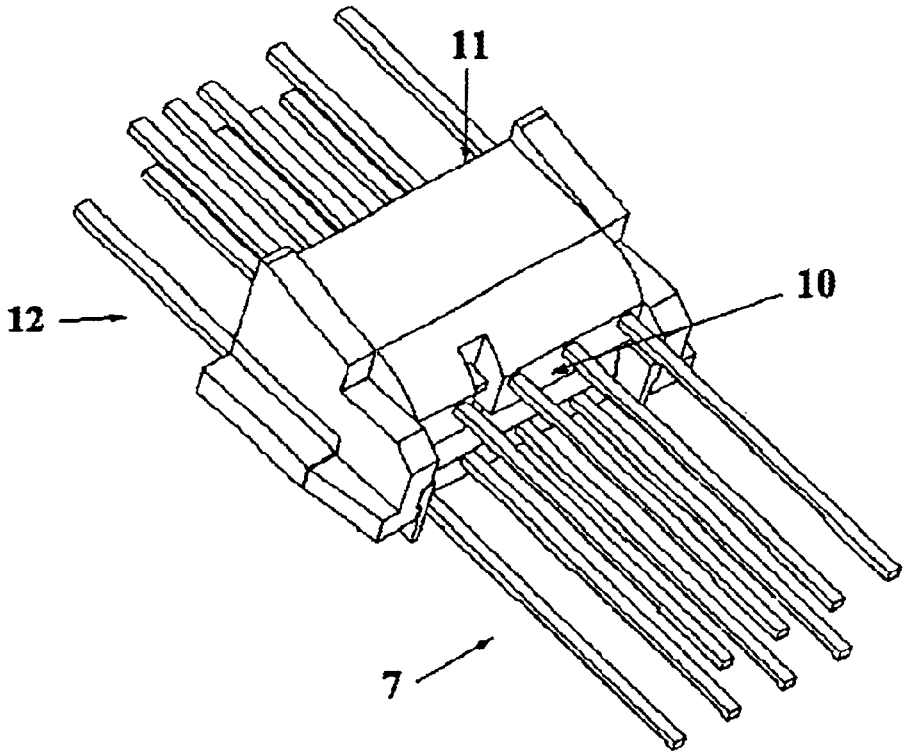
FIG. 5 is a perspective view of the superimposed strips of FIG. 3 encapsulated to form the jack of the invention.
Figure 6:
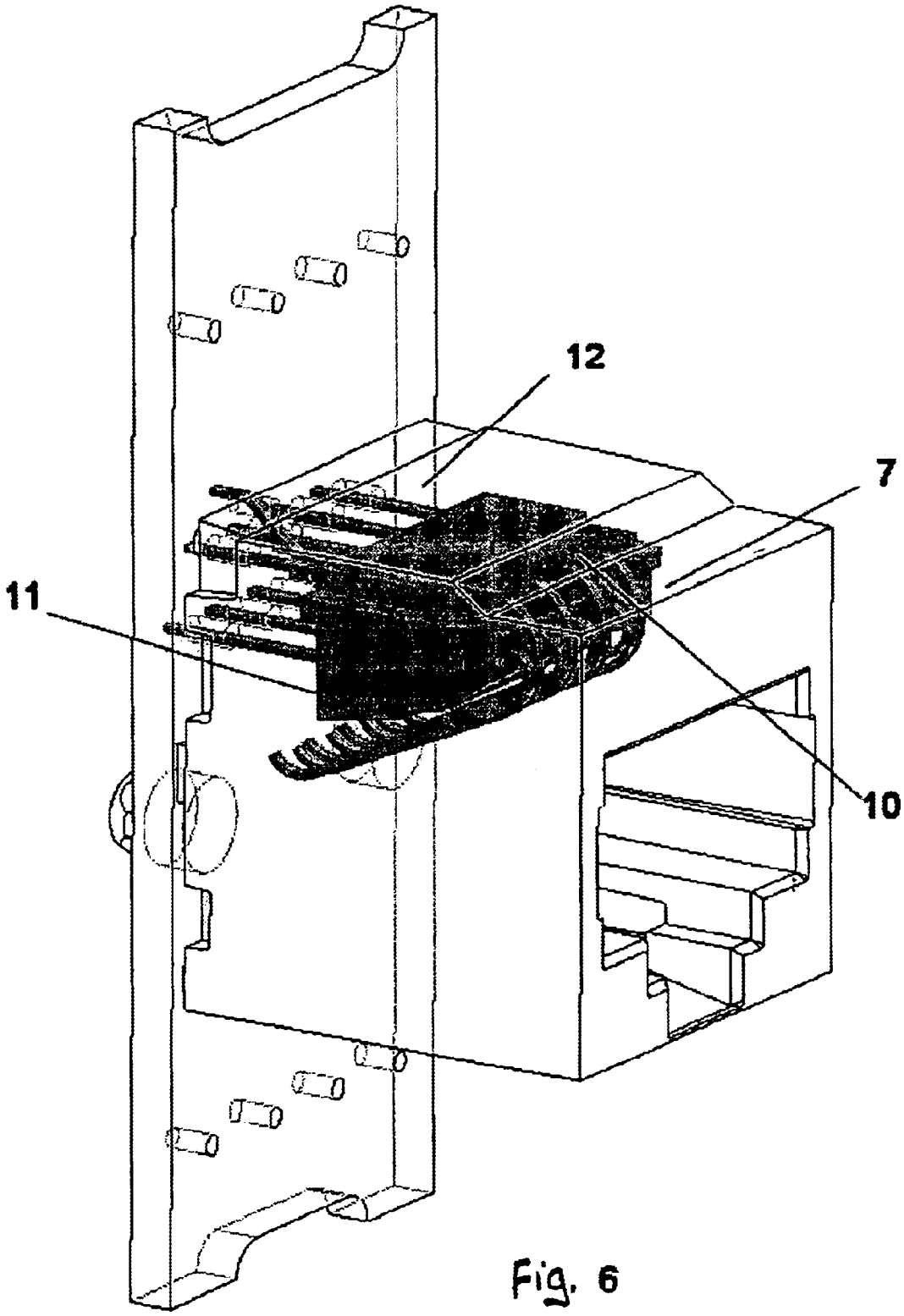
FIG. 6 is a perspective view of the jack of FIG. 5 mounted on a board and incorporated into a jacket socket.

Once the encapsulation has been completed so that the configuration shown on the left hand portion of FIG. 4 has been achieved the strips 4 complete with the encapsulation 9 may be cropped from the side regions 2,3, trimmed to size, and in the case of the contact portions bent with the conventional reverse bend. Each of the D strips (LD and UD) are cropped immediately adjacent the side 10 of the encapsulation 9 which faces the contact portions 7. Accordingly, the contact portions 7 total eight in number in accordance with conventional RJ45 standards. On the reverse face 11 of the encapsulation facing the connection portions 12 of the strips a total of ten strips leave the encapsulation. As will be appreciated by those skilled in the art, eight of these form contact portions which may be connected to tracks of a printed circuit board on which the jack is mounted to provide electrical connections to the eight contacts provided by the contact portion 7. The remaining two strip portions (provided by the LD and UD strips) are preferably each connected to one of the other contact portions. The required connection can conveniently be provided by means of tracks on the printed circuit board to which the jack is attached. The exact connection arrangements will depend on the connections required to provide the desired cross-talk characteristics. In certain instances it may be possible to provide a direct connection between one or both of the LD and UD strips and an adjacent contact portion, thereby obviating the need for additional tracks on the PCB.

It will be noted that, in the assembled configuration of the strips, the pad 6 associated with strip UE overlies and is substantially coterminous with the pad 6 of the strip LA. Similarly, the pad of the strip UC overlies and is substantially coterminous with the pad 6 of the strip LC. Finally, the pad 6 of the strip UA overlies and is substantially coterminous with the pad 6 of the strip LE. The pairs of mating pads 6 do not materially affect the cross-talk of the jack but are useful in assisting impedance matching of the jack.

It will be appreciated that whilst in the preferred embodiment of the invention the contact portions of strips LD and UD are electrically connected to their respective overlying and underlying strips UB and LB other arrangements may be desirable depending on the exact nature of the cross-talk reduction which is required.

Whilst in the preferred embodiment of the invention two extra strips LD and UD are provided, it will be appreciated that the invention is not limited to the use of two additional strips but on the contrary encompasses any number of additional strips depending on the nature of the cross-talk compensation required.

What is claimed is:

1. A jack comprising a body having mounted thereon a multiplicity of metal strips, the metal strips including:

a first group of metal strips each of which includes a contact portion for contacting a conductor of a mating plug and a connection portion for connection to a printed circuit board on which the jack, in use, is mounted;

a second group of metal strips each of which extends parallel and adjacent to at least one metal strip of the first group over a part of a length of the metal strip of the first group, each of the metal strips of the second group having a first end forming a connection portion for connection to a printed circuit board on which the jack is, in use, mounted, and a second end which is spaced apart from said metal strips of said first group;

an encapsulation encapsulating portions of all the metal strips such that the contact portions extend from a first side of the encapsulation whereby the connection portions of the first group of metal strips may be connected to tracks of the printed circuit board to effect an electrical connection between each contact portion and a track on the printed circuit board; and means electrically connecting each metal strip of the second group and a metal strip of the first group which is different from the metal strip of the first group to which the metal strip of the second group lies adjacent, such that each said metal strip of the second group forms a conducting spur connected only at one end to said metal strip of the first group.

2. A jack as claimed in claim 1, wherein the metal strips of the second group are cropped so that they do not include any portion in a region of the contact portions of the first group of metal strips.

3. A jack as claimed in claim 1, wherein the strips are formed by two superimposed layers of a pre-formed common blank, one of the layers of blank being inverted relative to the other layer.

4. A jack as claimed in claim 1, wherein at least some of the strips include pad portions which cooperate with pad portions of others of the strips to enhance impedance matching characteristics of the jack.

5. A jack as claimed in claim 1, wherein the metal strips include a common region which is a suitable plastics material.

6. A jack as claimed in claim 5, wherein the contact portions of the first group extend from one end of the encapsulated region and the connection portions of the first group of strips extend from another end of the encapsulated region.

7. A jack as claimed in claim 5, wherein the strips of the second group do not extend beyond the first side of encapsulated region.

* * * * *